United States Patent [19]

Roske

[11] 4,326,350

[45] Apr. 27, 1982

[54] ALUMINUM FOIL LABEL FOR BOTTLES

[75] Inventor: Dieter Roske, Hann.-Münden, Fed. Rep. of Germany

[73] Assignee: Haendler & Natermann GmbH, Hann.-Münden, Fed. Rep. of Germany

[21] Appl. No.: 153,221

[22] Filed: May 27, 1980

[30] Foreign Application Priority Data

May 26, 1979 [DE] Fed. Rep. of Germany ..... 2921402

[51] Int. Cl.[3] ..... G09F 3/00

[52] U.S. Cl. ..... 40/310; 40/615; 40/2 R; 40/2 B; 428/463; 428/138

[58] Field of Search ..... 40/2 R, 2 B, 2.2, 615, 40/310; 428/463, 128

[56] References Cited

U.S. PATENT DOCUMENTS

| | | | |
|---|---|---|---|
| 250,376 | 12/1881 | Massey | 40/2 B |
| 786,745 | 4/1905 | Fletcher | 40/2 B |
| 2,645,170 | 10/1953 | Nestor | 40/310 |
| 2,654,171 | 10/1956 | Northrup | 40/615 |
| 2,768,460 | 10/1953 | Nestor | 40/310 |
| 3,828,454 | 8/1974 | Hafner et al. | 40/2 R |

*Primary Examiner*—Robert A. Hafer
*Assistant Examiner*—Wenceslao J. Contreras
*Attorney, Agent, or Firm*—Sprung, Felfe, Horn, Lynch & Kramer

[57] ABSTRACT

Aluminum foil labels for bottles are disclosed which have on both sides a colorless or colored coating provided with an imprint on the outside, if desired, the aluminum foil label being adapted to cover the closure and part of the bottle—neck and to be affixed thereto with the aid of a glue which is soluble in an alkaline cleaning liquor. In accordance with the invention the coating comprises a varnish coating which is insoluble in the alkaline cleaning liquor. The coating can have mutually opposite weak areas which can consist of uncoated stripes. Also disclosed are bottles comprising a bottle body to which is attached such aluminum foil coated on both sides thereof with a varnish coating which is insoluble in an alkaline cleaning liquor. The insoluble varnish coating defines open areas which are opposed from open areas on the opposed insoluble varnish coating.

13 Claims, 3 Drawing Figures

ALUMINUM FOIL LABEL FOR BOTTLES

Figure 1:
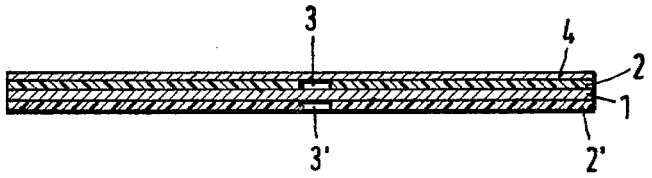

This invention relates to a aluminum foil label for bottles, which has on both sides a colorless or colored coating and is provided with an imprint on the outside, if desired, and is adapted to cover the closure and part of the bottleneck and to be affixed thereto with the aid of a glue which is soluble in an alkaline cleaning liquor.

Such aluminum foil lables have a thickness of 10 to 20 microns and are relatively inexpensive and are used mainly on bottles from which the labels are to be removed, such as wine and beer bottles which are to be returned for refilling. The labels can be applied at high rates and are mainly applied by means of dextrin glue, casein glue, vegetable glue or a mixed glue and sometimes by means of adhesive dispersions.

The bottles are cleaned with strongly alkaline liquors, in most cases with caustic soda solutions in a concentration of 1.5 to 3%, and sometimes with solutions of sodium metasilicate. To improve the spreading of the alkaline cleaning liquor and to facilitate the removal of the labels from the bottles, wetting agents are added to said liquors.

The bottles are usually cleaned in two steps. The first step consists of a treatment with an alkaline solution and constitutes the actual cleaning step, in which the bottle contained, e.g., in a cell moves continuously for 3 to 10 minutes through the strongly alkaline cleaning bath, which is at a temperature of 75° to 90° C. In this step the coating of the aluminum foil label, the lable itself and the glue are separated from the bottle without a residue and are dissolved. In the second step the bottles are rinsed with a clear rinsing fluid to remove the alkalinity.

As a result of the alkaline treatment, sodium aluminate as well as hydrogen are formed, which are both undesirable because sodium aluminate is a cause of a hardly justified pollution of the sewage and hydrogen is a constant explosion hazard. Another disadvantage resides in that aluminum hydroxide will form if there is a deficiency of active alkaline substance in the aqueous solution; such aluminum hydroxide will collect and form crusts at the bottom of the cleaning vessel and its removal involves a relatively high expenditure of work and time.

For this reason it is an object of the present invention to device methods by which a dissolution of the aluminum foil label of the kind described first hereinbefore and the resulting disadvantages can be avoided to a high degree.

This object can be accomplished in that the aluminum foil label is provided on both sides with a coating which is insoluble in alkaline cleaning liquors so that such liquor can dissolve virtually only the glue from the edges of the label and the latter will remain substantially unaffected until it is discharged.

This measure can be used to advantage with aluminum foil labels which are removed when the glue near the edges is still relatively soft because the label has been applied only a relatively short time before.

But even labels on which the glue near the edges has already fully hardened can be detached within the short time in which the bottle passes through the cleaning bath if, in accordance with a further feature of the invention, the coatings on both sides have mutually opposite weak areas, where the alkaline liquor can enter so that said liquor will dissolve aluminum only in said weak areas and adjacent to said weak areas will dissolve the still relatively soft glue in the region surrounded by the marginal areas, in which the glue has been more or less hardened. The label is thus divided into several sections and only up to 10% of the aluminum are dissolved.

In a preferred embodiment of the invention, the insoluble coating is omitted in the weak areas and, in accordance with a further preferred feature of the invention, weak areas at least on the outside of the label may be provided with a soluble coating.

The weak areas may be formed in that the label is provided with an imprint consisting of a mark or ornament. The invention is illustrated by way of example on the drawing and will now be explained further. FIG. 1 is a transverse sectional view showing an aluminum foil label 1, which is coated on both sides with a polyvinylchloride varnish 2, 2' which is insoluble in an alkaline cleaning liquor and has been omitted in mutually opposite weak areas 3, 3'. The polyvinylchloride coating on the outside of the label is covered by a coating 4 of soluble varnish.

Figure 2:
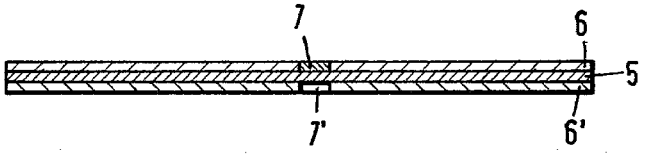

FIG. 2 is a transverse sectional view showing an aluminum foil label 5 which is provided on both sides with a coating 6, 6', which is insoluble in analkaline cleaning liquor and has been omitted in weak areas 7, 7'. The weak area 7 on the outside of the label is covered with soluble varnish.

Figure 3:
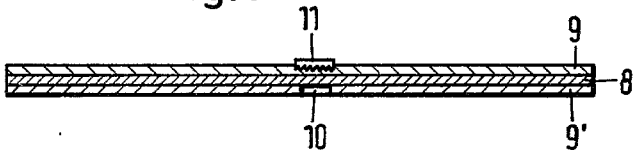

The aluminum label 8 shown in FIG. 3 is coated on both sides with a coating 9, 9', which is insoluble in an alkaline cleaning liquor. The coating 9' facing the bottle has weak areas 10, which register with a weak area formed on the other side by the imprint 11.

I claim:

1. In an aluminum foil label for bottles, which has on both sides a colorless or colored coating which is insoluble in an alkaline cleaning liquor said coating provided with mutually opposite weak areas.

2. An aluminum foil label according to claim 1 wherein the weak areas consist of uncoated stripes.

3. An aluminum foil label according to at least the weak areas on the outside of the label are filled with soluble varnish.

4. An aluminum foil label according to claim 1 wherein the weak areas are formed by an imprint provided on the outside of the label.

5. In an bottle having an aluminum foil label thereon, said label provided with a coating on both sides thereof, said coating being insoluble in an alkaline cleaning liquor, the improvement wherein said coating has mutually opposite weak areas.

6. An aluminum foil label for bottles comprising an aluminum foil, said aluminum foil coated on both sides thereof with a varnish coating which is insoluble in an alkaline cleaning liquor, said insoluble varnish coatings defining open areas which are opposed from open areas on the opposed insoluble varnish coating.

7. An aluminum foil label according to claim 6, wherein at least some of said open areas are filled with a varnish which is soluble in said alkaline cleaning liquor.

8. An aluminum foil label according to claim 6, wherein to at least one of said insoluble varnish coatings there is disposed a glue.

9. An aluminum foil label according to claim 7, wherein to at least one of said insoluble varnish coatings there is disposed a glue.

10. An aluminum foil label according to claim 7, wherein said glue is disposed on the side of said label opposed from said soluble varnish.

11. A bottle comprising a bottle body to which is attached an aluminum foil label, said aluminum label comprising an aluminum foil, said aluminum foil coated on both sides thereof with a varnish coating which is insoluble in an alkaline cleaning liquor, said insoluble varnish coating defining open areas which are opposed from open areas on the opposed insoluble varnish coating.

12. A bottle according to claim 11 wherein at least some of said open areas are filled with a varnish which is soluble in said alkaline cleaning liquor.

13. A bottle according to claim 11 wherein between an insoluble varnish coating on said aluminum foil and said bottle body there is disposed a glue.

* * * * *